United States Patent [19]

Johnson et al.

[11] 4,117,761

[45] Oct. 3, 1978

[54] FIRE CONTROL MECHANISM

[75] Inventors: James H. Johnson, New Haven; Arnold L. Fowler, Guilford; Julius E. Brooks, Branford; Harvey H. Friend, Hamden, all of Conn.

[73] Assignee: Olin Corporation, New Haven, Conn.

[21] Appl. No.: 540,150

[22] Filed: Mar. 31, 1966

[51] Int. Cl.[2] ..... F41D 11/10

[52] U.S. Cl. ..... 89/129 B; 42/1 F; 89/140; 142

[58] Field of Search ..... 89/128, 129 R, 129 B, 89/132, 139-146, 148-154, 191, 192, 193; 42/69.15, 1.2

[56] References Cited

U.S. PATENT DOCUMENTS

| | | | |
|---|---|---|---|
| 827,259 | 7/1906 | McClean | 89/152 |
| 2,031,383 | 2/1936 | Mendoza | 42/69 A |
| 2,213,348 | 9/1940 | Pomeroy | 89/141 |

*Primary Examiner*—Stephen C. Bentley
*Attorney, Agent, or Firm*—William W. Jones; Paul J. Lerner

EXEMPLARY CLAIM

1. In a firearm; an operating rod disposed for reciprocation between a breech closed position and a recoil position in response to the cyclic rate of the firearm; sear means spring biased into a holding position for retaining said operating rod in a cocked position; trigger means pivotable into a firing position to release said sear from said holding position; counter cam means having a cam surface rotatably mounted in said firearm in a position to be rotated by said operating rod; a trigger bar mounted in said firearm for movement into one of three preselected positions, said preselected positions including an automatic position, a semi-automatic position, and a controlled burst fire position; selector means for moving said trigger bar into said preselected positions; said trigger bar in said semi-automatic position being out of contact with said sear means and engageable with said counter cam to prevent said counter cam from being rotated whereby a single round is fired with each pivot of said trigger means, in said automatic position being engageable with said counter cam to prevent rotation thereof and operable to be moved by said trigger means upon pivoting thereof to a position to cam said sear and prevent said sear from retaining said operating rod in a cocked position whereby rounds are continuously fired as long as said trigger means remains pivoted, in said controlled burst fire position being engageable with said cam surface of said counter cam to be moved upon rotation of said counter cam into a position to cam said sear and prevent said sear from retaining said operating rod in a cocked position whereby a predetermined number of rounds are fired upon pivoting said trigger means.

6 Claims, 6 Drawing Figures

INVENTORS:
JAMES H. JOHNSON
ARNOLD L. FOWLER
JULIUS E. BROOKS
HARVEY H. FRIEND

BY H. Samuel Frieser
ATTORNEY

INVENTORS:
JAMES H. JOHNSON
ARNOLD L. FOWLER
JULIUS E. BROOKS
HARVEY H. FRIEND
BY
H. Samuel Kieser
ATTORNEY INVENTORS:
JAMES H. JOHNSON
ARNOLD L FOWLER
JULIUS E BROOKS
HARVEY H. FRIEND
BY
H. Samuel Kieser
ATTORNEY

FIRE CONTROL MECHANISM

This invention relates to firearms, and more particularly, to a firearm having a novel fire control mechanism adjustable for various modes of fire.

It is an object of this invention to provide a fire control mechanism for a hand-held firearm which is easily adjusted for semi-automatic fire, in which a single round is fired each time the trigger is pulled; automatic fire, in which the weapon continues to fire as long as the trigger is pulled; and burst fire, in which a predetermined number of rounds is fired from the weapon each time the trigger is pulled.

It is a further object of this invention to provide a fire control mechanism for semi-automatic, automatic and burst fire, which has a minimum number of piece parts, which can be economically manufactured and which is dependable in operation and readily assembled.

It is yet another object of this invention to provide a trigger mechanism that is easily adjusted for semi-automatic fire, automatic fire, or controlled burst fire, and which also can be used to fire a grenade launcher.

These and other objects and advantages of the invention will be more readily understood in light of the detailed description below and the accompanying drawings in which.

Figure 1:
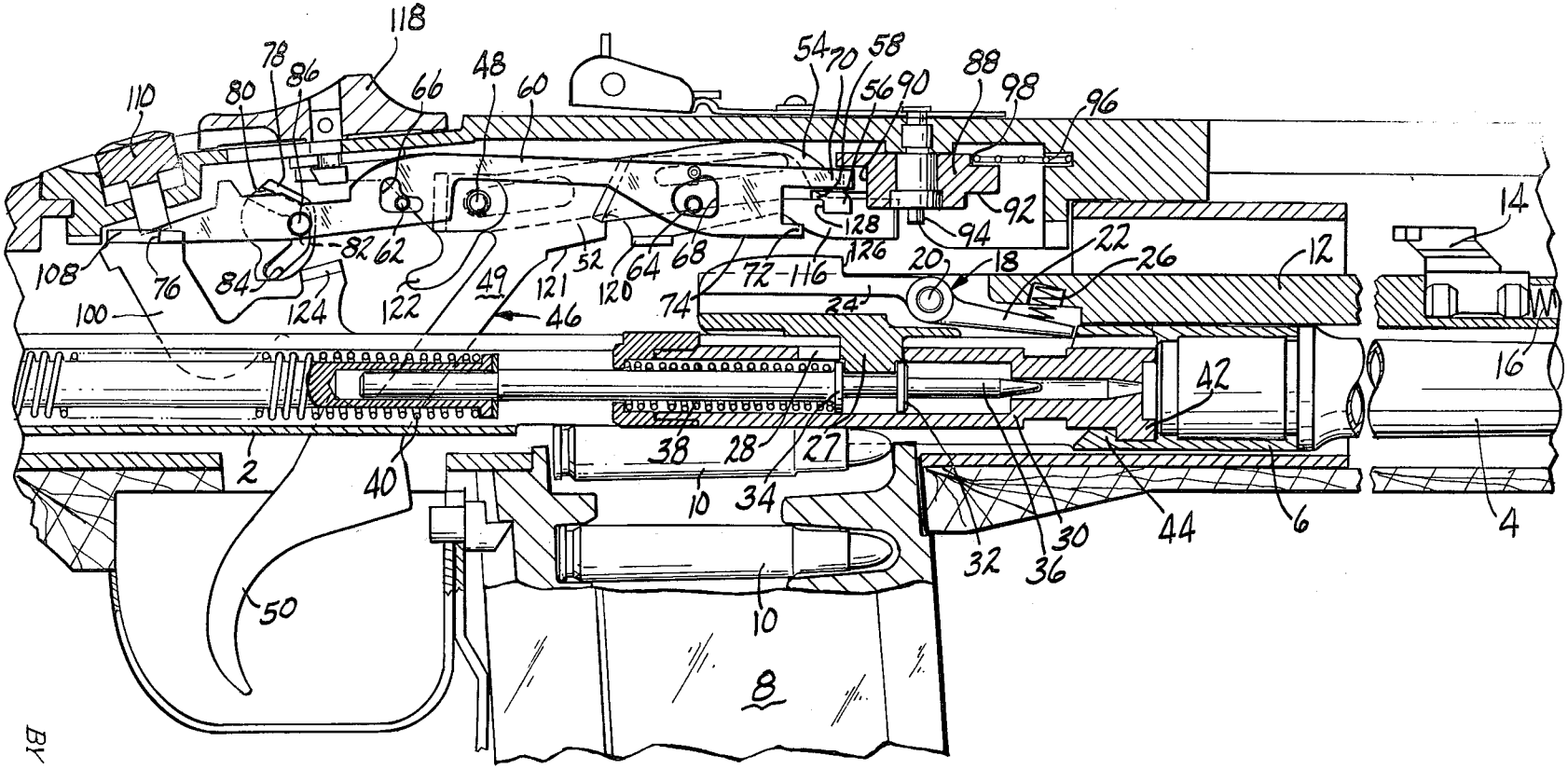
FIG. 1 is a fragmentary transverse sectional view of a firearm incorporating the fire control mechanism of this invention and showing the elements positioned for semi-automatic fire.

Referring to the drawings, and particularly to FIG. 1, the firearm of this invention includes a receiver 2 to which is attached a barrel 4 having a barrel extension 6. A magazine 8 is mounted at the bottom of the receiver 2, supplying cartridges 10 into the receiver in a well-known manner. An operating rod 12 is mounted above the barrel 4 and extends rearwardly over the receiver 2. The operating rod 12 is actuated by gas pressure tapped from the barrel 4, this gas pressure acts upon a piston (not shown) mounted in a cylinder (not shown) connected to the barrel 4 forwardly of the operating rod 12 in a well-known manner. A pawl member 14 is mounted for limited reciprocal movement on the operating rod 12 and is spring biased toward the rear of the firearm by a pawl spring member 16.

A sear 18 is pivotally mounted at the rearward end of the operating rod 12 on pin 20 and includes a forward barrel extension engaging arm 22 and a rearward cam arm 24. A sear spring 26 biases the barrel engaging arm 22 downwardly and in a clockwise direction about the pin 20 as shown in FIG. 1.

The operating rod 12 includes a projection 27 which extends downwardly through an opening in the receiver 2 and through a cam opening 28 in the bolt member 30. The projection 27 is positioned between lug members 32 and 34 on the firing pin 36. A firing pin booster spring 38 biases the firing pin 36 forwardly within the bolt member 30. A recoil spring 40 is mounted between the firing pin 36 and butt plate (not shown) of the firearm. The bolt 30 is adapted to move reciprocally between a breech open position, wherein the forward face of the bolt 30 is positioned rearwardly of the cartridges in the magazine 8, and a breech closed position, wherein the lugs 42 on the forward face thereof interlock with corresponding lugs 44 on the barrel extension 6. The firing pin 36 is held in the cocked position by the barrel engaging arm 22 of the sear 18 contacting the barrel extension 6 as shown in FIG. 1.

A trigger member 46 is pivotally mounted within the firearm on a trigger pivot pin 48 and includes a downwardly extending arm 49 terminating in a finger gripping portion 50 and a forwardly extending arm 52 including a trigger extension 54 having limited sliding movement on the forward end thereof. The forward end of the trigger extension 54 includes a laterally offset sear engaging portion 56 and a trigger bar engaging portion 58.

A trigger bar 60 is mounted for special movement on a rearward fixed pin 62 and a forward fixed pin 64 which extend through generally L-shaped cam slots 66 and 68 respectively. The forward end of the trigger bar 60 includes an upper projection 70 and a lower projection 72. The bottom surface of the forward portion of the trigger bar 60 includes a sear camming surface 74. The rearward portion of the trigger bar 60 includes an auxiliary sear engaging surface 76 which extends transversely to the axis of the barrel 4 and bolt 30.

Figure 2:
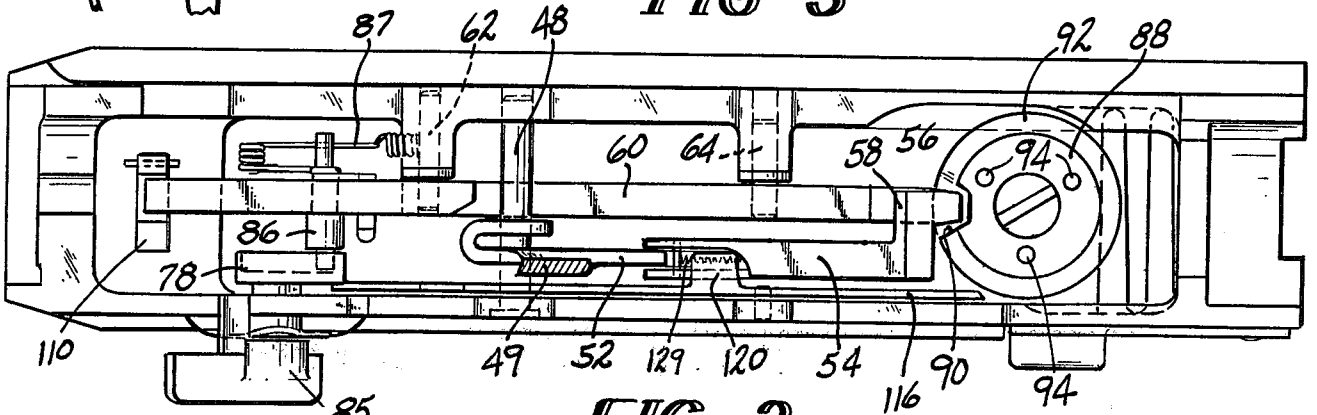
FIG. 2 is a fragmentary cross-sectional view taken along the lines 2 — 2 of FIG. 1.

The trigger bar 60 is adapted to be moved into various positions by a selector cam 78 which includes a cam track having an upper portion 80, middle portion 82, and lower portion 84. The selector cam 78 may be attached to a lever 85 mounted on the outside of the housing of the fire control mechanism. A cam follower 86 has one end attached to the trigger bar 60 and the opposite end extending into the cam track of the selector cam 78. A suitable trigger bar spring 87 (FIG. 2) biases the trigger bar 60 rearwardly and the rearward portion thereof downwardly.

A counter cam 88 is position forwardly of the trigger bar 60 and is adapted to rotate about a fixed axis. The counter cam 88 includes a notch 90 into which the upper projection 70 of the trigger bar 60 is adapted to extend. The counter cam 88 also includes a bottom cam surface 92 and three downwardly extending projections 94. A spring member 96 extends between the housing and an upper triangularly-shaped detent portion 98 on the counter cam 88 to snap the counter cam into one of three positions.

Figure 4:
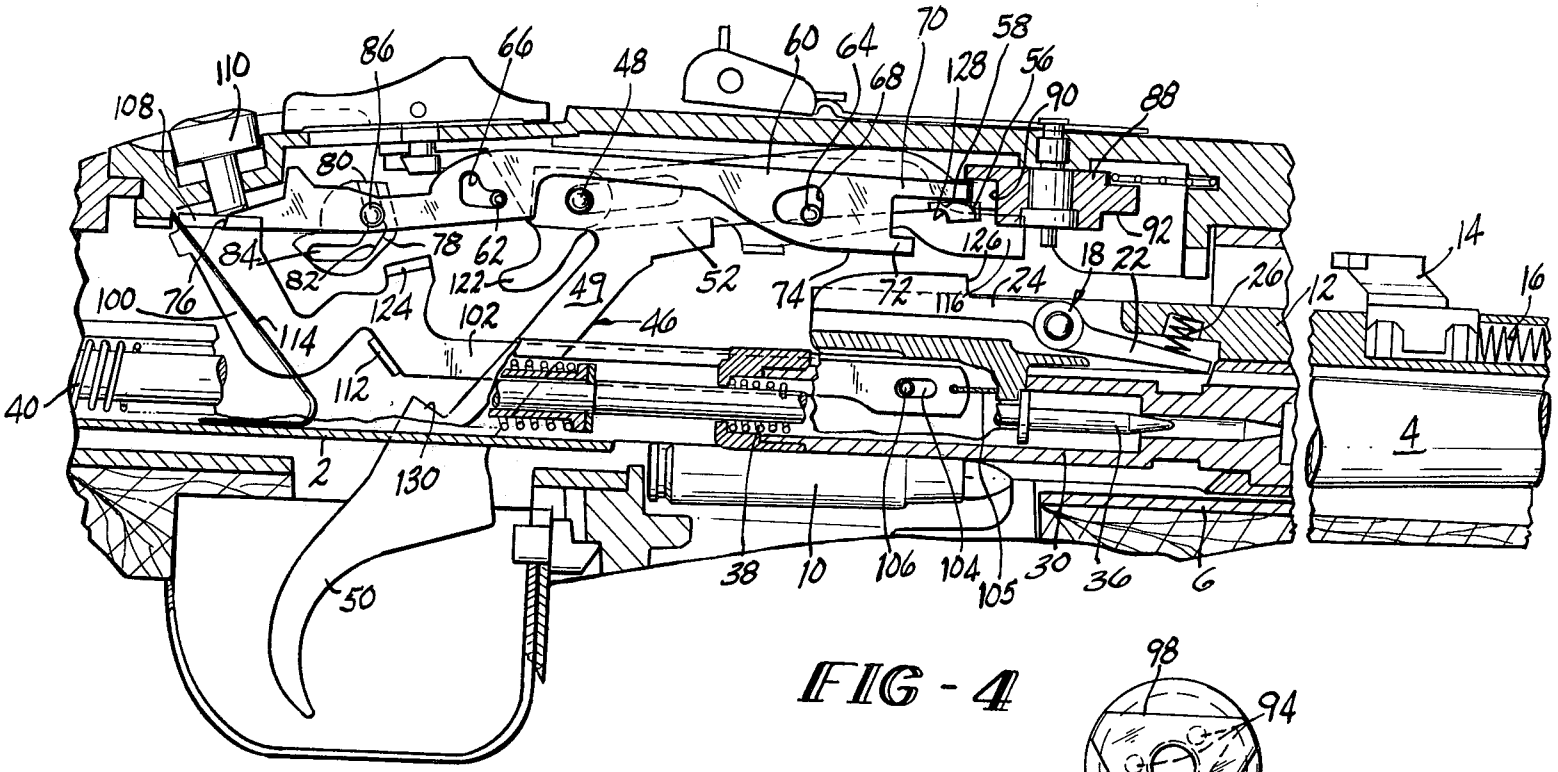
FIG. 4 is a view similar to FIG. 1, but showing the fire control system positioned for control burst firing.
Figure 5:
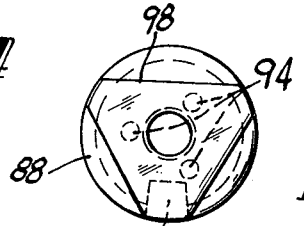
FIG. 5 is an enlarged side view of the counter cam.
Figure 6:
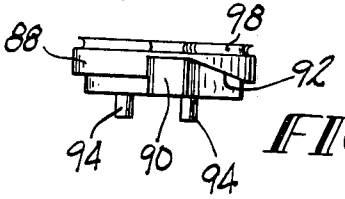
FIG. 6 is a top plane view of the counter cam.

A connector bar 100 is mounted in the firearm on one side of the receiver 2 for actuation by the trigger member 24 to fire a grenade launcher (not shown) such as the type described in copending application Ser. No. 468,187 filed June 25, 1965. As best shown in FIG. 4, the connector bar 100 includes a forward arm-like portion 102 having an elongated slot 104 in its forward portion which receives a fixed pin 106. A wire connection 105 is attached to the forward portion 102 through a hole 107 and extends forwardly in the firearm to the grenade launcher. The rearward portion of the connector bar 100 extends upwardly and terminates in a flange 108 which is adapted to be contacted by a grenade launcher button 110. A trigger contacting flange 112 is provided for contact by the trigger member when the button 110 is depressed. A suitable spring member 114 is positioned between the firearm and the connector bar 100 and biases the connector bar 100 forwardly and upwardly.

A safety bar 116 is mounted to the side of the trigger bar 60 and is adapted to be moved by a safety button 118 slidable between a first firing position and a second safety position. The safety bar 116 includes a flange 120 adapted to be moved underneath portion 121 of the trigger member in a manner to prevent rotation thereof, and a second hook-like portion 122 adapted to be positioned underneath a flange 124 on the connector bar 100 to prevent the connector bar from being depressed by the grenade launcher button 110.

To position the fire control mechanism for semi-automatic firing, the selector cam 78 is moved into its middle position wherein the cam follower 86 is contained within the middle position 82 of the cam track. In this position, as shown in FIG. 1, the trigger bar 60 is located in its middle position wherein the rearward pin 62 is locked between the upper and lower surfaces of the base portion of the L-shaped cam slot 66 and the lower surface cam slot 68 is positioned against the forward pin 64. Upper projections 70 on the forward end of the trigger bar 60 is positioned within the notch 90 in the counter cam 88 whereby the counter cam 88 is prevented from rotation when one of the projections is contacted by pawl member 14. The sear 18 has its forward arm 22 in engagement with the barrel extension 6 whereby the firing pin 36 is held in its cocked position.

With the elements so positioned, when the trigger member 46 is pulled, it forwardly extending arm portion 52 and trigger extension 54 are rotated clockwise in a downwardly direction, and the sear engaging portion 56 thereof contacts the cam arm 24 of the sear 18 rotating the barrel extension engaging arm 22 out of engagement with the barrel extension 6. At this point, the combined action of the booster spring 38 and recoil spring 40 force the firing pin, as well as the operating rod forward, whereby the firing pin can fire the cartridge.

Through the action of the gases acting upon the piston, the operating rod 12 is thrown rearwardly carrying along with it the bolt 30. Upon its return to the forward position, the bolt 30 picks up a cartridge from the magazine and positions it in the cartridge receiving chamber. The sear 18 having its forward barrel extension arm 22 spring biased downwardly, will engage the barrel extension 6 holding the firing pin 36 in the cocked position.

If, as the operating rod 12 is moved forwardly, the trigger member 46 has not been released by the operator, the forward face 126 on the cam arm 24 of the sear 18 will engage the rearward face 128 of the sear engaging portion 56 of the trigger extension 54. As the trigger extension 54 is slidably mounted on arm 52 of the trigger member 46, the trigger extension 54 moves forward with the operating rod 12 until the sear 18 abuts the barrel extension 6. Upon release of the trigger member 46, the trigger spring will cause the trigger member 46 to pivot back into its prefiring position, rotating the trigger extension 54 counterclockwise upwardly and away from the sear 18. A suitable trigger extension spring member 129 forces the trigger extension 54 back to its unextended position. If the trigger is again pulled, the above sequence is repeated, firing a single round for each pull of the trigger.

Figure 3:
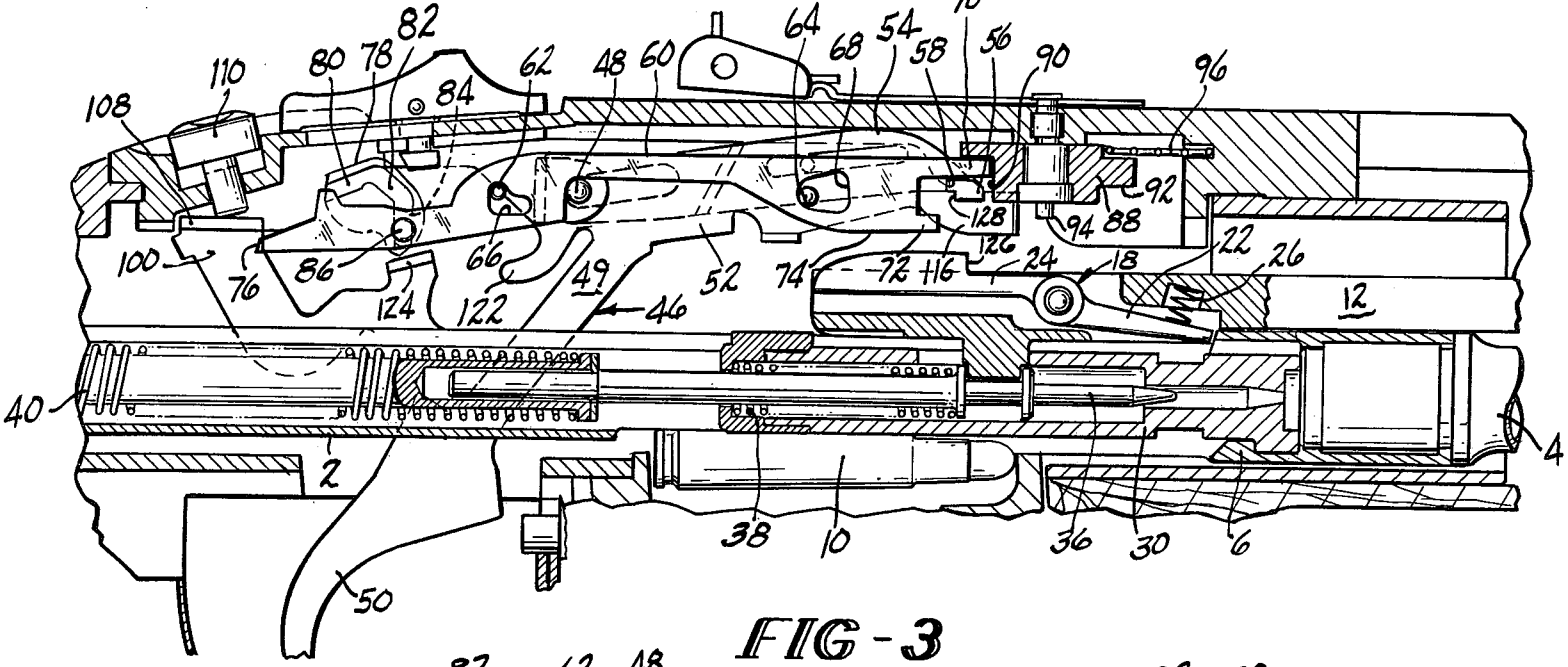
FIG. 3 is a view similar to that of FIG. 1, but showing the fire control system positioned for full automatic firing.

To set the mechanism for automatic firing, the selector cam 78 is rotated into its forward position wherein the cam follower 86 is positioned in the lower portion 84 of the cam track as shown in FIG. 3. This action moves the trigger bar 60 into its forward position with the upper projection 70 positioned in notch 90 in the counter cam 88, whereby rotation is prevented. The rearward fixed pin 62 is positioned in the upper portion of the leg of cam slot 66 and the forward fixed pin 64 is positioned at the rearward end of the base of the cam slot 68. The trigger bar spring 87 biases the rearward portion of the trigger bar 60 downwardly into contact with the trigger pivot pin 48 so that the auxiliary sear engaging surface 76 is in its lower position. The entire trigger bar 60 has been moved forward so that the tip of lower projection 72 of the trigger bar 60 is positioned underneath the trigger bar engaging portion 58 of the trigger extension 54 in a position to be engaged thereby upon downward movement thereof.

If the selector cam 78 is changed to the automatic from another position, the operating rod 12 will be in the cocked position with the sear 18 engaging the barrel extension 6 and the firing pin 36 cocked. Upon pulling the trigger member 46, the trigger extension 54 pivots clockwise in the manner heretofore explained. However, as the trigger extension 54 moves downwardly, the trigger bar engaging portion 58 will contact the trigger bar 60, pivoting the forward portion thereof downwardly about pivot pin 48 and effecting an upward pivotal movement of the rearward portion of the trigger bar 60. In like manner as in semi-automatic fire, the trigger extension 54 will release the sear 18 permitting forward movement of the operating rod 12 and firing pin 36 whereby the cartridge is fired.

Under the action of the piston member actuated by the gas pressure, the operating rod 12 will be thrown rearwardly so that upon forward motion thereof, the bolt 30 will pick up a cartridge from the magazine and position it within the cartridge receiving chamber. If the trigger member 46 remains pulled, as the operating rod moves forward, the sear 18 will be cammed out of engagement with the barrel extension 6 by the sear camming surface 74 on the bottom of the forward portion of the trigger bar 60 which is held downward by virtue of the trigger bar engaging portion 58 of the trigger extension 54 being in engagement with lower projection 72. This will permit the operating rod 12 and the firing pin 36 to continue its forward motion whereby the firing pin 36 can fire the new cartridge. As long as the trigger remains pulled, this action will continue.

If, after a cartridge is fired, the trigger member 46 is released, the operating rod 12 will move rearwardly under the action of the piston member and upon return, the forward face 126 on the cam arm 24 of the sear 18 will abut the auxiliary sear engaging surface 76 on the rearward portion of the trigger bar 60 whereby the operating rod 12 and bolt 30 will be held in a breech open position. If the selector cam 78 is then moved into position for another mode of firing, the auxiliary sear engaging surface 76 will be moved upwardly, out of engagement with the sear 18, and the operating rod 12 and bolt 30 will move forward, positioning a new cartridge in the cartridge receiving chamber, and the sear 18 will contact the barrel extension 6 holding the firing pin 36 in a cocked position. If the selector cam 78 is not changed from the position for automatic fire, when the trigger member 46 is again pulled, the trigger extension 54 will pivot the auxiliary sear engaging surface 76 upwardly out of engagement with the sear 18 and the firing will proceed as heretofore described until the trigger member 46 is released.

To position the mechanism for three round burst fire, the selector cam 78 is moved to its rearward position moving the trigger bar 60 likewise to its rearward position as shown in FIG. 4. In this position, the cam follower 86 is positioned within the upper portion 80 of the cam track. The rearward fixed pin 62 is positioned in the forward position of the leg of the cam slot 66 and the forward fixed pin 64 is positioned against the forward portion bottom surface of the cam slot 68. Since the trigger bar 60 is in its rearward position, the upper projection 70 is not positioned within the notch 90 in the counter cam 88 and, accordingly, the counter cam is capable of being rotated. However, the top surface of the tip of the forward projection 70 is in contact with the bottom cam surface 92 of the counter cam 88.

Prior to firing a three round burst, the sear 18 is in engagement with the barrel extension 6 and the operating rod 12 holds the firing pin 36 in the cocked position. Pulling of the trigger member 46 will cause the trigger extension 54 to depress the rear cam arm 22 of the sear 18, releasing the arm 22 from the barrel extension 6, and permitting the firing pin 36 and operating rod 12 to move forward whereby the firing pin 36 can fire the cartridge. The gas-actuated piston then moves the operating rod 12 rearwardly whereby the pawl member 14 contacts the first of the counter cam projections 94, rotating the counter cam 88 120° into its second position. By virtue of the bottom cam surface 92 on the counter cam 88, the forward portion of the trigger bar 60 is depressed to a position wherein the sear camming surface 74 will contact the cam arm 24 of the sear 18 upon forward movement of the operating rod 12. Thus, as the operating rod 12 and bolt 30 move forward, the bolt 30 picks up a new cartridge, positions it within the cartridge chamber and, since the sear member 18 is held out of engagement with the barrel extension 6 by the sear camming surface 74 on the trigger bar 60, the operating rod 12 and firing pin 36 will continue their forward motion whereby the firing pin 36 can strike and fire the cartridge.

Upon firing of the second cartridge, the gas-actuated piston throws the operating rod 12 rearwardly whereupon the pawl member 14 contacts the second of the counter cam projections 94 and rotates the counter cam 88 another 120°. The bottom cam surface 92 on the counter cam 88 keeps the forward portion of the trigger bar 60 depressed in the position it was during the last cycle. Accordingly, as the operating rod 12 moves forward, the bolt 30 picks up the third cartridge and positions it within the cartridge receiving chamber. The sear 18 is prevented from engaging the barrel extension 6 by the depressed sear camming surface 74 of the trigger bar 60 whereby the firing pin 36 and operating rod 12 continue forward to fire the third cartridge. The gas-actuated piston again throws the operating rod 12 to the rear whereby the pawl member 14 engages the third of the counter cam projections 94 and rotates the counter cam 88 120° back to the starting position. At this point, the bottom cam surface 92 of the counter cam 88 is such that it permits the forward portion of the trigger bar 60 to move upwardly so that upon return of the operating rod 12 and bolt 30 the sear 18 will engage the barrel extension 6 and hold the firing pin 36 in the cocked position.

To operate the connector bar 100 whereby the trigger mechanism of the grenade launcher is actuated, the operator presses downwardly on the grenade launcher button 110 which pushes the connector bar 100 downwardly. At this point, the trigger contacting flange 112 is in a position to be engaged by a projection 130 on the trigger member 46 when the trigger member 46 is pulled. Pulling of the trigger member 46 moves the connector bar rearwardly which in turn pulls the connection 105 attached to the trigger mechanism of the grenade launcher. Firing of a cartridge at the same time as firing of the grenade launcher is prevented by the fact that the connector bar is limited in its axial movement by the fixed pin 106 in slot 104. This in turn limits the movement of the trigger member 46 to an amount less than that needed to effect release of sear 18.

While reference has been made to one particular embodiment of this invention, various alterations and modifications will readily suggest themselves to those skilled in the art. Accordingly, the scope of this invention should be ascertained by reference to the following claims.

What is claimed is:

1. In a firearm; an operating rod disposed for reciprocation between a breech closed position and a recoil position in response to the cyclic rate of the firearm; sear means spring biased into a holding position for retaining said operating rod in a cocked position; trigger means pivotable into a firing position to release said sear from said holding position; counter cam means having a cam surface rotatably mounted in said firearm in a position to be rotated by said operating rod; a trigger bar mounted in said firearm for movement into one of three preselected positions, said preselected positions including an automatic position, a semi-automatic position, and a controlled burst fire position; selector means for moving said trigger bar into said preselected positions; said trigger bar in said semiautomatic position being out of contact with said sear means and engageable with said counter cam to prevent said counter cam from being rotated whereby a single round is fired with each pivot of said trigger means, in said automatic position being engageable with said counter cam to prevent rotation thereof and operable to be moved by said trigger means upon pivoting thereof to a position to cam said sear and prevent said sear from retaining said operating rod in a cocked position whereby rounds are continuously fired as long as said trigger means remains pivoted, in said controlled burst fire position being engageable with said cam surface of said counter cam to be moved upon rotation of said counter cam into a position to cam said sear and pevent said sear from retaining said operating rod in a cocked position whereby a predetermined number of rounds are fired upon pivoting said trigger means.

2. The firearm of claim 1 wherein said trigger means includes a trigger extension and said sear means is pivotally attached to said operating rod and includes a forward face engageable with said trigger extension if said trigger remains pivoted at the end of one firing in semi-automatic fire and at the end of the preselected number of shots in controlled burst fire whereby said operating rod can return from its recoil position to its cocked position.

3. The firearm of claim 1 wherein said trigger bar includes an auxiliary sear surface, said auxiliary sear surface in said automatic position engageable with said sear means when said trigger is released to hold said operating rod in a breech open position.

4. The firearm of claim 1 wherein said trigger bar is mounted for movement about fixed pins and said trigger means is mounted on a fixed pivot pin; and further including spring means urging said trigger bar toward said counter cam and the rearward portion thereof downwardly, and cam track means rotatable into one of said three selected positions; said trigger bar when positioned in said automatic position being pivotable by said trigger means about said fixed pivot with the forward portion thereof moving downwardly and said auxiliary sear surface moving upwardly in a position out of engagement with said sear means.

5. The firearm of claim 1 further including grenade launcher trigger means comprising a grenade launcher button, a connector bar mounted for movement in said firearm and including a rearwardly extending arm portion positioned to be engaged and moved downwardly by said grenade button upon depression thereof and a forwardly extending arm portion having a slot, a pin fixed to said firearm and extending through said slot, and connector means extending forwardly from said forwardly extending arm portion for attachment to a grenade launcher trigger mechanism, whereby when said grenade launcher button is depressed, said trigger means is operable to engage said rearward arm portion to move said connector bar rearwardly, said slot limiting the movement of said connector bar and pivoting of said trigger means so that said trigger means does not contact said sear.

6. The firearm of claim 5 further including safety means comprising a safety bar movable from a firing position out of engagement with said trigger means and connector bar to a safety position wherein a flange on said safety bar is positioned to prevent rotation of said trigger member and a hook portion is positioned to prevent said connector bar from being depressed by said grenade launcher button.

* * * * *